US005845685A

United States Patent [19]

Cooper

[11] Patent Number: 5,845,685

[45] Date of Patent: Dec. 8, 1998

[54] METHOD AND APPARATUS FOR FILLING SANDBAGS

[76] Inventor: Jeffrey Erwin Cooper, 250 El Camino Dr., Ojai, Calif. 93023

[21] Appl. No.: 956,325

[22] Filed: Oct. 23, 1997

[51] Int. Cl.[6] ..... B65B 1/04

[52] U.S. Cl. ..... 141/108; 141/10; 141/314

[58] Field of Search ..... 141/10, 108, 109, 141/314, 316, 315; 294/1.1, 1.5, 55; 209/418

[56] References Cited

U.S. PATENT DOCUMENTS

| | | | |
|---|---|---|---|
| 133,562 | 12/1872 | Chaffin . | |
| 438,948 | 10/1890 | Robinson . | |
| 571,513 | 11/1896 | Davidson . | |
| 791,472 | 6/1905 | Kaiser . | |
| 3,936,087 | 2/1976 | Alexander | 294/1 R |
| 5,498,046 | 3/1996 | Ridley . | |
| 5,673,734 | 10/1997 | Hawley . | |

*Primary Examiner*—David J. Walczak
*Assistant Examiner*—Timothy L. Maust
*Attorney, Agent, or Firm*—Gene W. Arant

[57] ABSTRACT

A bag filler consisting of a single tubular member has a peripheral portion removed from one end thereof to form a hand grip while an opposing peripheral portion at the same end then forms a scoop, has its other end inserted into the open end of a bag to be filled, and the bag at both its ends is then turned about and within the associated ends of the tubular member so that an operator may with one hand hold both the open end of the bag and the hand grip of the tubular member for guiding the bag and bag filler into engagement with material from which the bag is to be filled, while the operator's other hand holds the bag and other end of the tubular member to propel the bag and bag filler.

2 Claims, 2 Drawing Sheets

4
18
17
10
20

10
18
4
32

18
10
16

19
D
20
C
24

METHOD AND APPARATUS FOR FILLING SANDBAGS

BACKGROUND OF THE INVENTION

When floods strike without warning there is often an urgent necessity to fill sand bags which may then be used to provide dikes for protection against the flooding water. It has generally been a cumbersome process to fill the sand bags, and particularly when one person is working alone.

SUMMARY OF THE INVENTION

The present invention provides a method and apparatus that will allow one person, working alone, to fill sand bags with sand in a very fast and efficient manner.

According to the invention a one-piece bagfiller is used to hold the bag open so that it can provide a scoop at the open end of the bag, the bag can receive the sand, and the operator may secure the scoop to the bag so that the bag will not slip longitudinally relative to the bagfiller. When the bag and bagfiller are at least partly filled, the bagfiller is removed.

Thus, it is the object of the invention to provide a one-piece apparatus usable by one person in conjunction with an empty sand bag to rapidly and efficiently fill the bag with sand.

DRAWING SUMMARY

DETAILED DESCRIPTION

(Drawing FIGS. 1–6)

Figure 1:
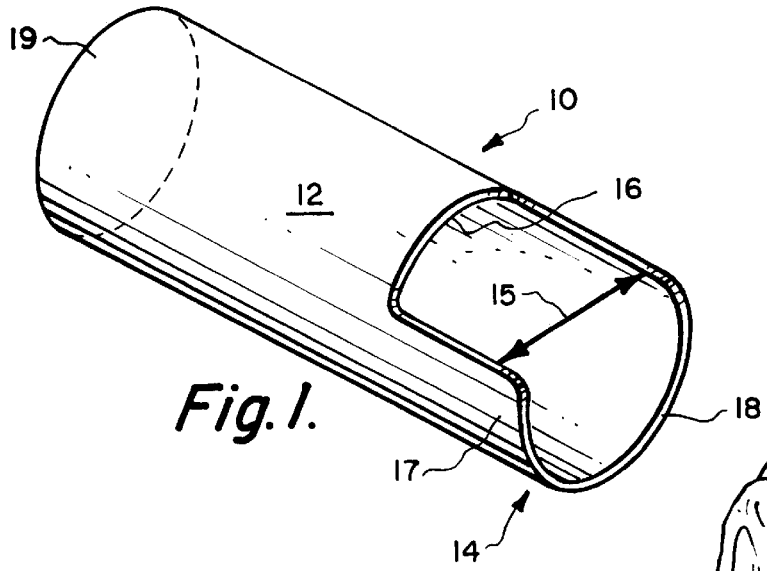
FIG. 1 is a perspective view of my novel bagfiller showing one end with a cutaway portion forming a scoop.
Figure 6:
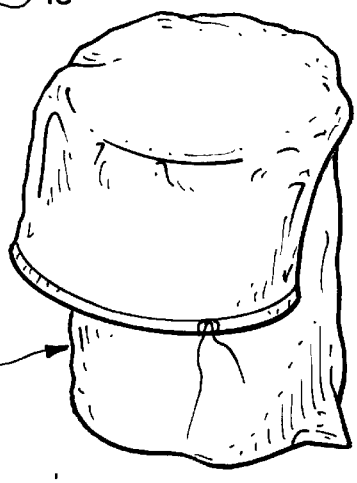
FIG. 6 shows the bag in erect position, with the unfilled top end of the bag drooping over the sand-filled portion to provide a convenient closure for the bag.

According to the present invention my novel bagfiller 10 is made from a single tubular member 12 such as a plastic pipe. Its outside diameter is selected to be slightly less than the inner diameter of the sand bag 20 when opened up. This makes it easy to slide the bagfiller longitudinally into the open end of the sand bag, causing the bottom portion of the sand bag to expand. The length of the bagfiller is selected to be about the same length as the bag, or somewhat less.

The width that the bag had when laying flat may be designated as W; the circumference of the bag when opened up into a cylindrical configuration as C; and the outside diameter of the bagfiller as D. Reviewing some calculations in geometry and arithmetic, it can then be shown that D must be slightly less than 7/11 of W. Alternatively, it may be said that the outside diameter of the bagfiller is about three-fifths of the width of the sand bag when laying flat. Calculations are not really necessary, however, since the diameter of the tubular member should be such as to slide easily into the open bag, while at the same time keeping the bag essentially open and its bottom end portion expanded while the bagfiller is being filled.

To complete my bagfiller, at one end 14 a peripheral portion of the tubular member is cut off leaving a peripheral opening 15 with an end edge 16. The opposing peripheral portion 17 of the tubular member then protrudes beyond the end edge 16 and assumes a scoop-like configuration. Although not specifically shown, it is preferred to have the end edge 18 of the scoop thinned to permit easier penetration of a sand pile.

Figure 2:
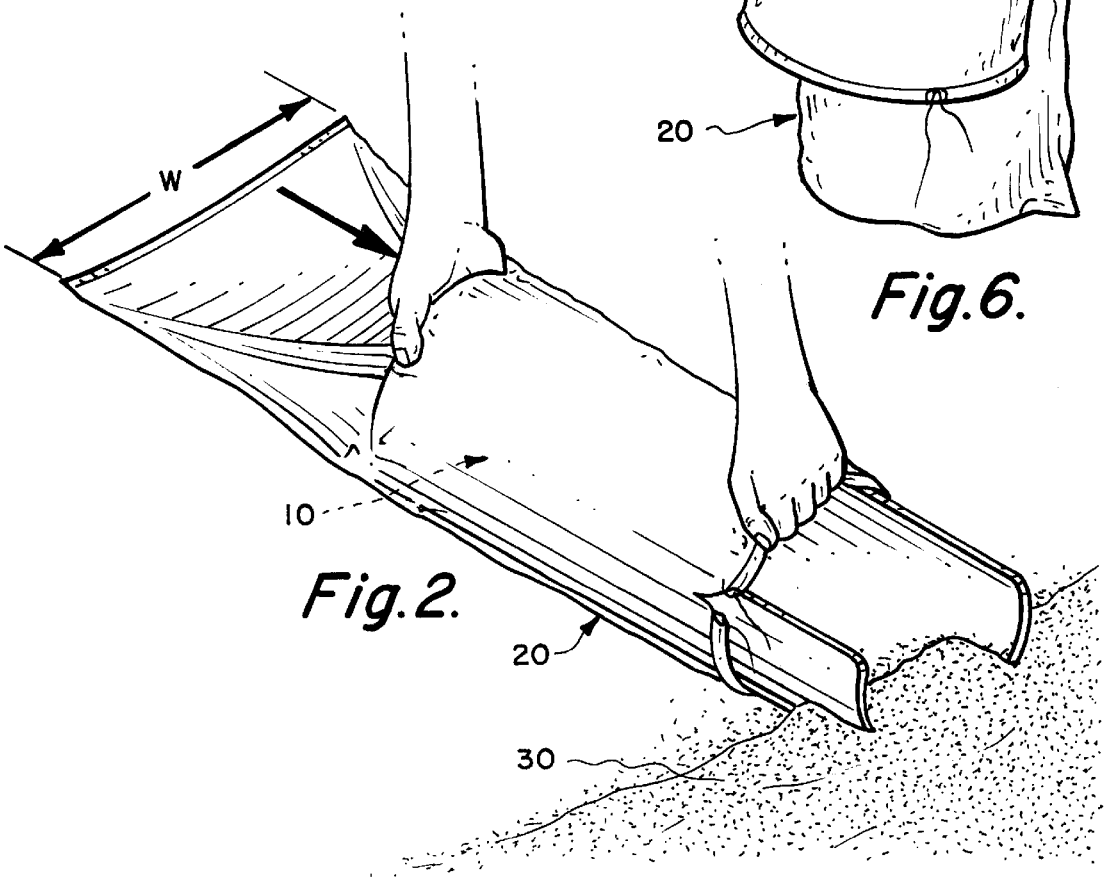
FIG. 2 is a perspective view of my bagfiller in place within a sand bag, showing the forward end of the bag and bagfiller being gripped together by hand and the scoop digging into a sand pile to scoop sand into the bagfiller and bag.
Figures 3, 4, 5:
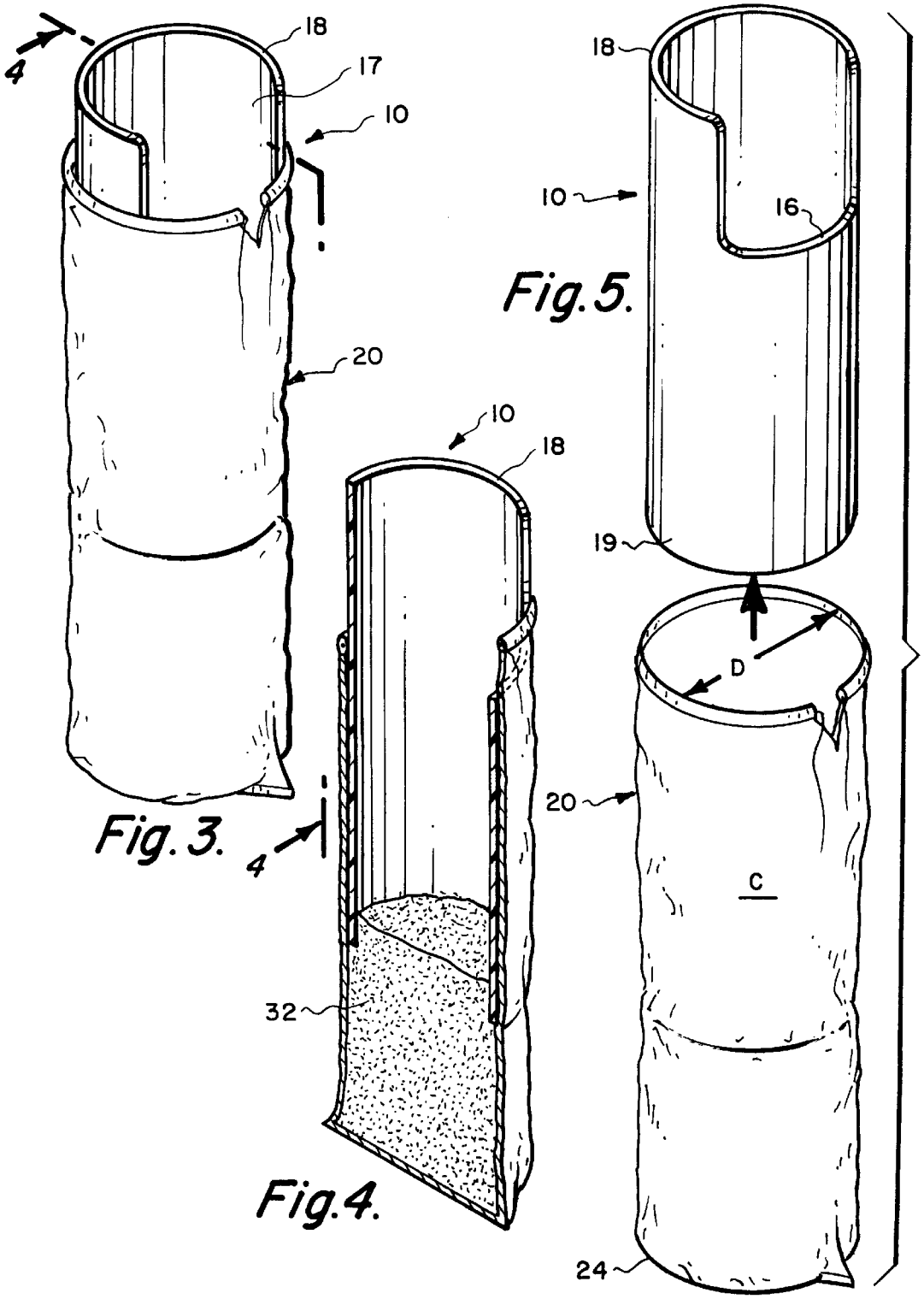
FIG. 3 is a perspective view of an open sand bag with my bagfiller inserted therein.
FIG. 4 is a cross-sectional view taken on line 3—3 of FIG. 3, showing the bag with bagfiller in place, and sand filling the bottom end of the bag and inner end portion of the bagfiller.
FIG. 5 is a view showing the partially filled bag in a vertically extended position and my bagfiller having been pulled upward out of it.

After the bagfiller is prepared or selected in the manner described above, the next step is to select an empty sand bag 20, see FIG. 3. As previously stated, the outer diameter of the bagfiller 10 is slightly less than the inner diameter of the sand bag when opened up into a cylindrical configuration. The round or uncut end 19 of the bagfiller is inserted into the bag 20, as shown in FIG. 3. It is inserted far enough so that the end edge 16 of the bagfiller 10 may be grasped by the hand of the operator at the same time as an end portion of the bag. As shown in FIG. 2, this makes it possible for the operator with one hand to hold the bag, hold the bagfiller, and keep the open end of the bag and much of its length in an open position. In order to manipulate the combination of bagfiller and bag in a desired direction, however, it is preferred, and may even be necessary, for the operator to use his or her other hand at the rear end of the bagfiller, as shown.

It will be noted that the uncut end 19 of the tubular member 12 retains its full circular configuration so that it may be inserted through the open end of a bag and may seat within the bottom end of the bag so that the bag is fully expanded and ready to be loaded.

As shown in the various drawing figures, the length of tubular member 12 is preferably slightly less than the length of the open sand bag. It is desirable to have the scoop portion of the bagfiller protrude beyond the open end of the bag. This arrangement assures that the sand 32 from the sand pile 30 will indeed be moved into the bagfiller 10 and through it to the bag 20, rather than into an annular space between bag and bagfiller. It is not necessary for the rearward end 19 of the bagfiller to extend into the extreme bottom end of the bag 20.

Once the bag has been filled to a desired amount, usually about ½ or ¾ of its actual capacity, the filling operation is terminated. The bag is stood up on its bottom end 24 as shown in FIG. 5, with the scoop 17 of the bagfiller pointed up. The user then grasps the scoop edge 18 and pulls the bagfiller vertically upward out of the bag. The bag may then be closed, and the bagfiller is ready to be used again.

Although a particular configuration has been shown for the scoop-like or shovel-like end of the bag filler, it will be understood that many different variations are possible within the scope of the invention.

Although plastic pipe is presently preferred to provide the tubular member, it will be understood that a pipe or a rigid tubular member of some different material will perform in essentially the same manner, and hence falls within the scope of the invention.

Although the invention has been described particularly with reference to filling sand bags, it will be understood that the same apparatus and method may be applied in filling a bag with some other type of generally granular material.

However, the application of the invention to sand is particularly important, in part because of the urgency of flood situations, and in part because the high density of sand and the amount being bagged makes it harder to handle than many other granular type materials.

What I claim is:

1. The combination of a bag and a bag filler, comprising:

a bag having an open end and a closed end, and being adapted to lie flat when empty;

a single tubular member having an outside diameter which is slightly less than three-fifths of the width of the bag when flat, and having a length which is about the same as the length of the bag;

one end of the tubular member having a peripheral portion removed to form a hand grip, while an opposing peripheral portion at the same end then forms a scoop, the other end of the tubular member retaining its full circular configuration;

the other end of the tubular member being inserted into the open end of the bag, causing the bag to expand;

the open end of the bag being pulled beyond and turned about and within the hand grip of the tubular member so that an operator may with one hand hold both the open end of the bag and the hand grip for guiding the scoop into engagement with material from which the bag is to be filled; and the bag near its closed end being turned over and within the other end of the tubular member so that the operator with his other hand may grip both the bag and the other end of the tubular member;

whereby the operator's one hand may then be used to guide the bag and bag filler into engagement with the material, while the other is used to propel the bag and bag filler.

2. The method of filling a sand bag, comprising the steps of:

selecting a bag filler consisting of a single tubular member having an outside diameter slightly less than three-fifths the flat width of the bag to be filled, and a length about the same as the length of the bag to be filled;

the tubular member being also selected to have an uncut end and having a cut end from which a peripheral portion has been removed to form a hand grip and so that an opposite peripheral portion forms a scoop;

inserting the uncut end of the tubular member into and through the open end of the bag and then seating it toward the bottom end of the bag, causing the bag to fully expand;

turning a portion of the open end of the bag inward and over the hand grip at the cut end of the tubular member;

with one hand, grasping the hand grip and concurrently the turned-over portion of the bag;

with the other hand, grasping the uncut end of the tubular member together with another portion of the bag near its bottom end which is turned inward and over the uncut end of the tubular member;

forcing the scoop into engagement with a sand pile and thereby at least partially filling the tubular member and bag;

placing the bag in a vertical position with its bottom end oriented in a downwardly direction so that the scoop of the tubular member is pointing up; and then withdrawing the tubular member from the bag so that whatever sand was in the tubular member is transferred into the bag.

* * * * *